United States Patent [19]

Shields

[11] 4,056,920

[45] Nov. 8, 1977

[54] LOADING APPARATUS

[76] Inventor: Walter A. Shields, 181-41 Henley Road, Jamaica, N.Y. 11432

[21] Appl. No.: 744,479

[22] Filed: Nov. 24, 1976

[51] Int. Cl.[2] ..... B65B 5/08; B65B 5/10; B65B 35/30

[52] U.S. Cl. ..... 53/142; 53/160; 53/166; 53/202; 53/246

[58] Field of Search ..... 53/142, 154, 160, 164, 53/166, 202, 246, 247, 248, 249, 251

[56] References Cited

U.S. PATENT DOCUMENTS

| | | | |
|---|---|---|---|
| 2,760,318 | 8/1956 | Brenneck et al. | 53/160 X |
| 3,054,235 | 9/1962 | Edgerly et al. | 53/142 X |

FOREIGN PATENT DOCUMENTS

| | | | |
|---|---|---|---|
| 2,020,470 | 11/1971 | Germany | 53/160 |

*Primary Examiner*—Robert Louis Spruill
*Attorney, Agent, or Firm*—C. Bruce Hamburg

[57] ABSTRACT

Apparatus is provided for loading a plurality of articles into a receptacle having parallel rows of openings each of which is adapted to receive a respective one of the articles. The apparatus comprises at least one loading station, and preferably two loading stations, each loading station including means for guiding and supporting the articles in a row parallel to and spaced above and laterally of a row of the openings to be filled with the row of articles. The guiding and supporting means include movable guide means for engaging the row of articles laterally. The apparatus further includes means for moving the movable guide means between a position in which the movable guide means laterally engages the row of articles and a position in which the movable guide means is disengaged from the row of articles. Moreover, there are provided carrying means for the row of articles, means for moving the carrying means into engagement with the articles thereby to provide support for and carry the articles when the movable guide means is disengaged from the articles and for then moving the carrying means with the row of articles carried thereby laterally toward and into vertical alignment with the openings of the row of openings to be filled with the row of articles.

9 Claims, 22 Drawing Figures

FIG. I.

LOADING APPARATUS

BACKGROUND OF THE INVENTION

This invention relates to a loading apparatus. More particularly, the invention relates to an apparatus for loading a plurality of articles into a receptacle having parallel rows of openings each of which is adapted to receive a respective one of the articles.

The background of the invention and the details of the invention itself will be described in the context of loading syringe sub-assemblies into trays. It will be apparent, however, that the principles of the invention have broader applicability.

At one point in the manufacture of hypodermic syringes, syringe sub-assemblies must be loaded into trays for storage and shipment. Each of the syringe sub-assemblies is constituted of a syringe barrel or vial, usually of glass, having a flange at one end thereof and a throat at the other end thereof with a hypodermic needle secured to the vial at the throat thereof and a rubber sheath covering the needle and sufficiently tightly fit on the throat that it will not fall off but can be removed manually by being pulled firmly when the time has come to use the syringe. The open extremity of the sheath which fits on the throat is of larger external diameter than at the rest of the sheath. The syringe sub-assemblies are to be loaded into the respective openings in the trays with the sheath end of the sub-assembly pointing vertically downwardly. The openings in the tray are usually arranged in 10 rows of 10 openings each. The openings in each row of openings are staggered relative to the openings in each adjacent row of openings. Each opening for a sub-assembly is actually constituted of a pair of vertically aligned openings, the upper one of which is in an upper horizontal plate of the tray and the lower one of which is in a lower horizontal plate of the tray. Both plates are near the top of the tray. When the syringe sub-assemblies are loaded into the tray, each is supported by the resting of the undersurface of the annular flange at the open end of the vial upon the portion of the upper plate surrounding the opening therein in which the sub-assembly has been received, the sheathed lower end of the sub-assembly being suspended slightly above the bottom of the tray.

Manual loading of these trays is, of course, inefficient. Machine loading posed many problems, which is was the object of the present invention to solve. Notable among these problems was the automatic simultaneous insertion of syringe sub-assemblies into entire rows of these openings, each of the sub-assemblies having to be perfectly aligned with the openings and perfectly guided down into the openings without getting caught at the edge of the opening either in the upper plate or the lower plate. Such problems are all solved by the present invention.

Other objects and advantages of the invention will be apparent from the following description.

SUMMARY OF THE INVENTION

There is provided according to the invention an apparatus for loading a plurality of articles into a receptacle having parallel rows of openings each of which is adapted to receive a respective one of the articles. The apparatus comprises at least one loading station, preferably two, including means for guiding and supporting the articles in a row parallel to and spaced above and laterally of a row of the openings to be filled with the row of articles. The guiding and supporting means includes movable guide means for engaging the row of articles laterally. The apparatus further comprises means for moving the movable guide means between a position in which the movable guide means laterally engages the row of articles and a position in which the movable guide means is disengaged from the row of articles. Moreover, there are provided carrying means for the row of articles, means for moving the carrying means into engagement with the articles thereby to provide support for and carry the articles when the movable guide means is disengaged from the articles and for then moving the carrying means with the row of articles carried thereby laterally toward and into vertical alignment with the openings of the row of the openings to be filled with the row of articles, means for increasing the spacing between the carrying means to a spacing corresponding to the spacing between the openings of the row to be filled as the articles are laterally carried by the carrying means into vertical alignment with the openings of the row to be filled and means for moving the carrying means vertically downwardly thereby to lower the articles partly into the openings. The means for moving the carying means laterally includes means for then moving the carrying means laterally in reverse of the former lateral movement thereby to disengage the carrying means from the articles partly received in the openings to permit the articles to descend further into the openings.

The apparatus also includes means for receiving and guiding the lower portion of each of the articles into each respective opening when the carrying means lower the articles and means for moving the receiving and guiding means laterally from a position laterally spaced from the row of openings being filled to a position in vertical alignment with the openings thereby to perform the receiving and guiding of the lower portion of each of the articles and then, after the carrying means has been disengaged from the articles, laterally back to the original position thereof thereby to disengage the lower portion of each of the articles and permit the articles to descend further into the openings whereby the loading of the row of articles into the row of openings is completed.

The loading apparatus is used in combination with means for continuously feeding the articles to the means in the loading station for guiding and supporting the articles in a row. The guiding and supporting means are of such length as to have a capacity to receive from the feeding means a row of the articles of greatest number than the number of openings in the row of openings in the receptacle for receiving the articles. The loading apparatus includes pulling and holding back means for pulling back into the feeding apparatus the excess articles on the guiding and supporting means and holding back the feeding of additional articles from the feeding means into the loading apparatus while the row of articles remaining in the loading apparatus is loaded by the loading apparatus in the row of openings in the receptacle.

The loading apparatus also includes a carriage for supporting the receptacle and means for horizontally indexing the carriage perpendicularly to the rows of openings in the receptacle thereby to bring successive rows of empty openings into position for loading with respective rows of articles.

Preferably, the apparatus includes like laterally spaced loading stations on opposite sides of the apparatus. In that case, two continuous feeding means are provided, each of the feeding means feeding to the guiding and supporting means of a respective one of the loading stations. Moreover, the loading stations are arranged so that the indexing of the carriage results in one of the loading stations loading articles in the rows of openings of one lateral half of the receptacle while the other loading station loads articles in the rows of openings of the other lateral half of the receptacle.

For the precise handling of the hereinabove mentioned syringe sub-assemblies, the receiving and guiding means comprise upper and lower receiving and guiding means and the apparatus further comprises means for moving the lower guiding and receiving means laterally away from the sub-assemblies before the upper guiding and receiving means is so moved. The lower receiving and guiding means include respective surfaces for supporting each of the sub-assemblies by engaging the periphery of the upper end of the sheath of each thereof and the upper receiving and guiding means include respective surfaces for supporting each of the sub-assemblies by engaging the flange of the vial of each thereof. The receiving and guiding means are vertically spaced above the openings a distance such that when both the upper and lower receiving and guiding means are in engagement with the subassemblies, the sub-assemblies are supported by the lower receiving and guiding means with the lowermost extremity of each of the sheaths extending into a respective opening in the lower plate of the tray, and when the lower receiving and guiding means is withdrawn before the upper receiving and guiding means, the sub-assemblies slide down deeper into the tray until the subassemblies are supported by the upper receiving and guiding means. Consequently, the subsequent withdrawing of the upper receiving and guiding means permits the articles to descend further into the openings and completes the loading of the row of articles into the row of openings.

DESCRIPTION OF A PREFERRED EMBODIMENT

Figure 1:
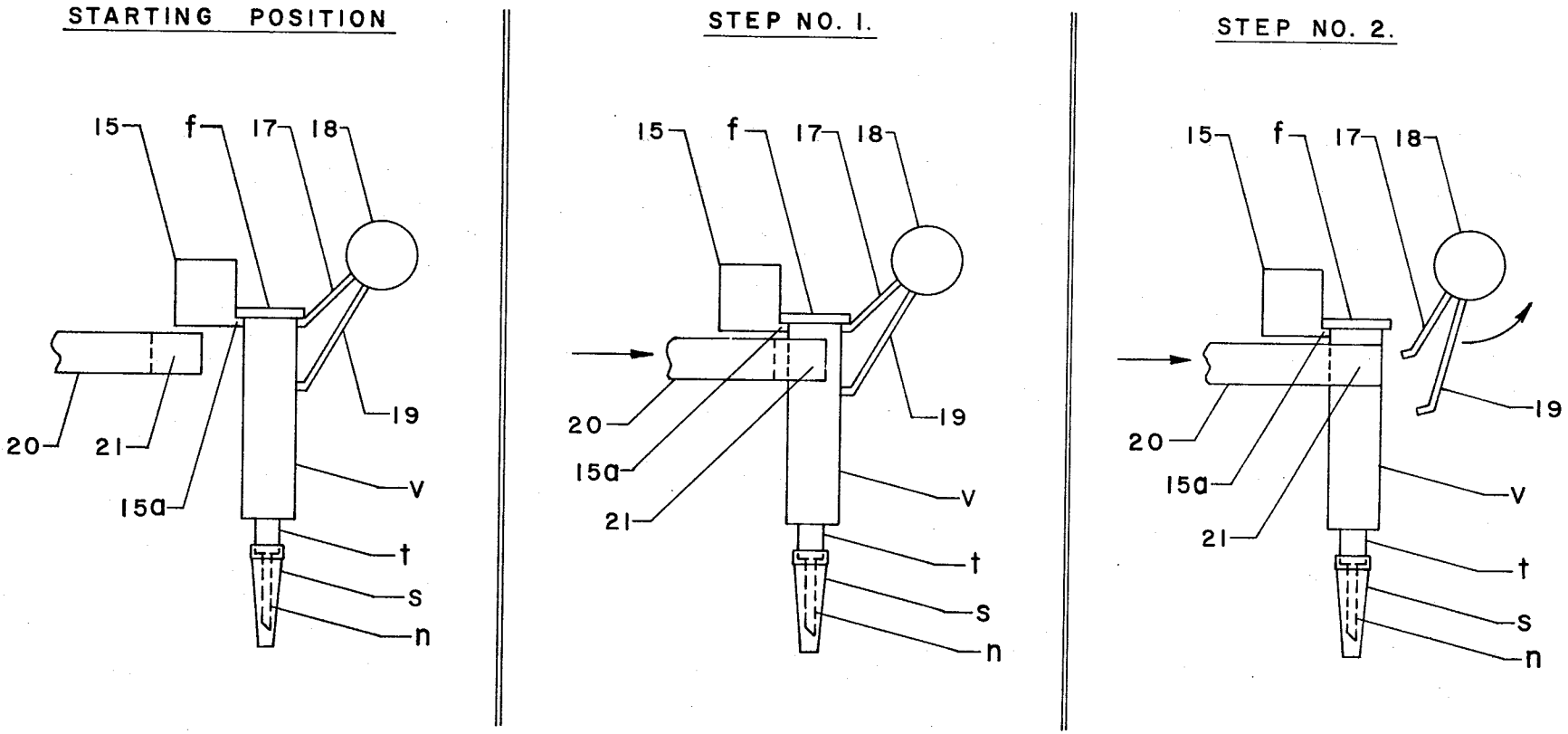
FIGS. 1,2 and 3 are views illustrating the successive steps performed on syringe sub-assemblies by apparatus of the invention in loading the sub-assemblies into trays.

The apparatus illustrated in FIGS. 1-22, which is a preferred embodiment of the invention, performs the function of loading syringe sub-assemblies into trays for shipping and storage of the sub-assemblies. In the particular embodiment herein described each tray holds one hundred of the sub-assemblies, though, like other particular minor details of this embodiment, this is not a limitation on the invention. Each of the syringe sub-assemblies, as shown in FIG. 1 for example, is constituted of a syringe barrel or vial *v*, usually of glass, having a flange *f* at one end thereof and a throat *t* at the other end thereof with a hypodermic needle *n* secured to the vial *v* at the throat *t* thereof and a rubber sheath *s* covering the needle *n* and sufficiently tightly fit on the throat *t* that it will not fall off but can be removed manually by being pulled firmly when the time has come to use the syringe.

The packaging machine or tray loader 10 (FIGS. 4 and 5) according to the invention includes a straight line vibratory feeder 11 (FIGS. 4,5 and 22) having two pairs of tracks 12 mounted thereon. Each of the pairs of tracks 12 is supplied with syringe sub-assemblies by gravity from a respective pair of tracks 13 inclined downwardly from a known type of machine, such as that disclosed in U.S. Pat. No. 3,623,210, in which various operations such as placing of the sheaths over the needles and washing, have been performed. One tray loader according to the invention therefore handles the output of two such machines. However, if one of those machines should become inoperative, the tray loader can still function with the output of only the other machine, the only consequence being the approximate doubling of the time required to load a tray. Since the tray loader is symmetrical, it will be described herein generally with reference to the handling of syringe sub-assemblies fed from one washing machine, it being understood that simultaneously the other side of the tray loader is handling syringe sub-assemblies fed from the other washing machine in the same way. Considering that the tray loader incorporates a pair of mirror-image stations for simultaneously loading two rows of syringe sub-assemblies into a ten row tray, a carriage 14 (FIG. 4, for example) indexes the tray perpendicular to the direction of the rows of openings therein for receiving the sub-assemblies so that a cycle of tray loading comprises simultaneously loading the following pairs of rows, first and sixth, second and seventh, third and eighth, fourth and ninth, and fifth and 10th. When one of the washing machines is inoperative, either only the odd numbered or even numbered rows are loaded as the carriage 14 indexes from left to right (FIG. 6), then after the carriage 14 has returned to its start position, marking the end of a cycle, the operator turns the tray 180° and then turns the machine on to run through another cycle, in which the empty rows of the tray are now loaded. In other words, with both washing machines operative, one tray is loaded per cycle of the tray loader 10, whereas with only one washing machine operative, two cycles of the tray loader 10 are required for loading of a tray. Incidentally, in the drawings the convention has been adopted of indicating working motions of elements of the apparatus with solid line arrows and return motions with broken line arrows.

Figure 2:
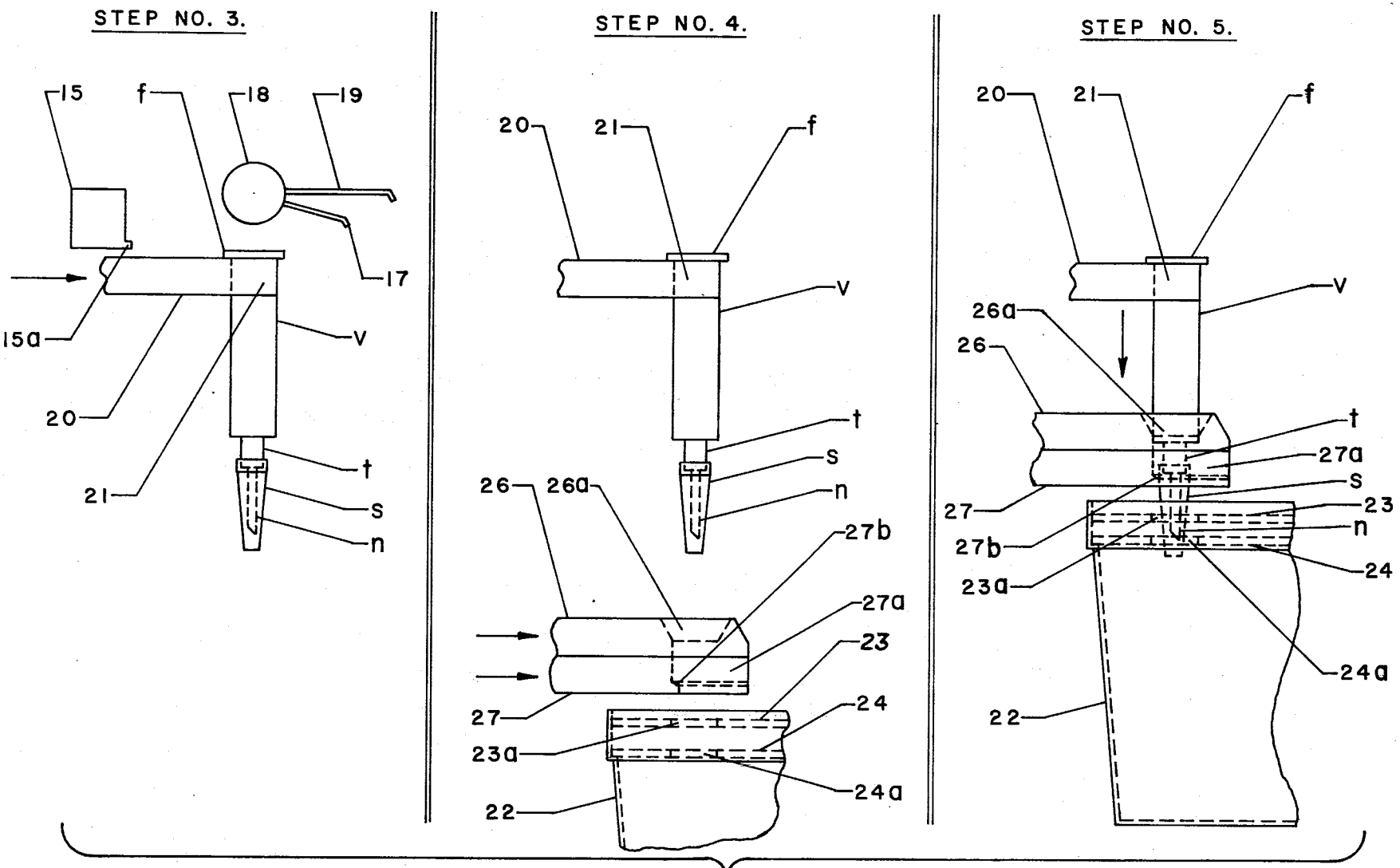
Figure 3:
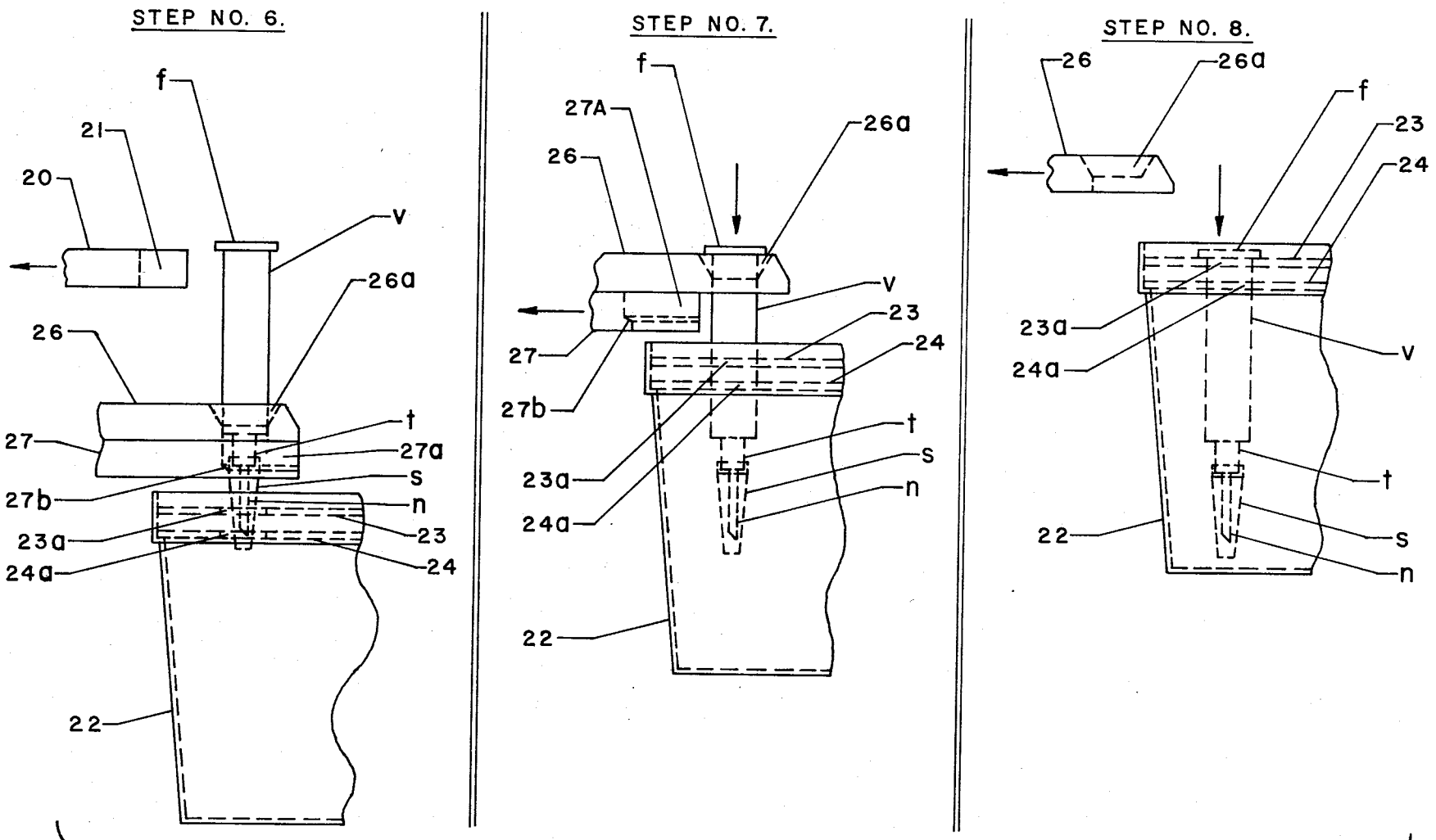
Figure 4:
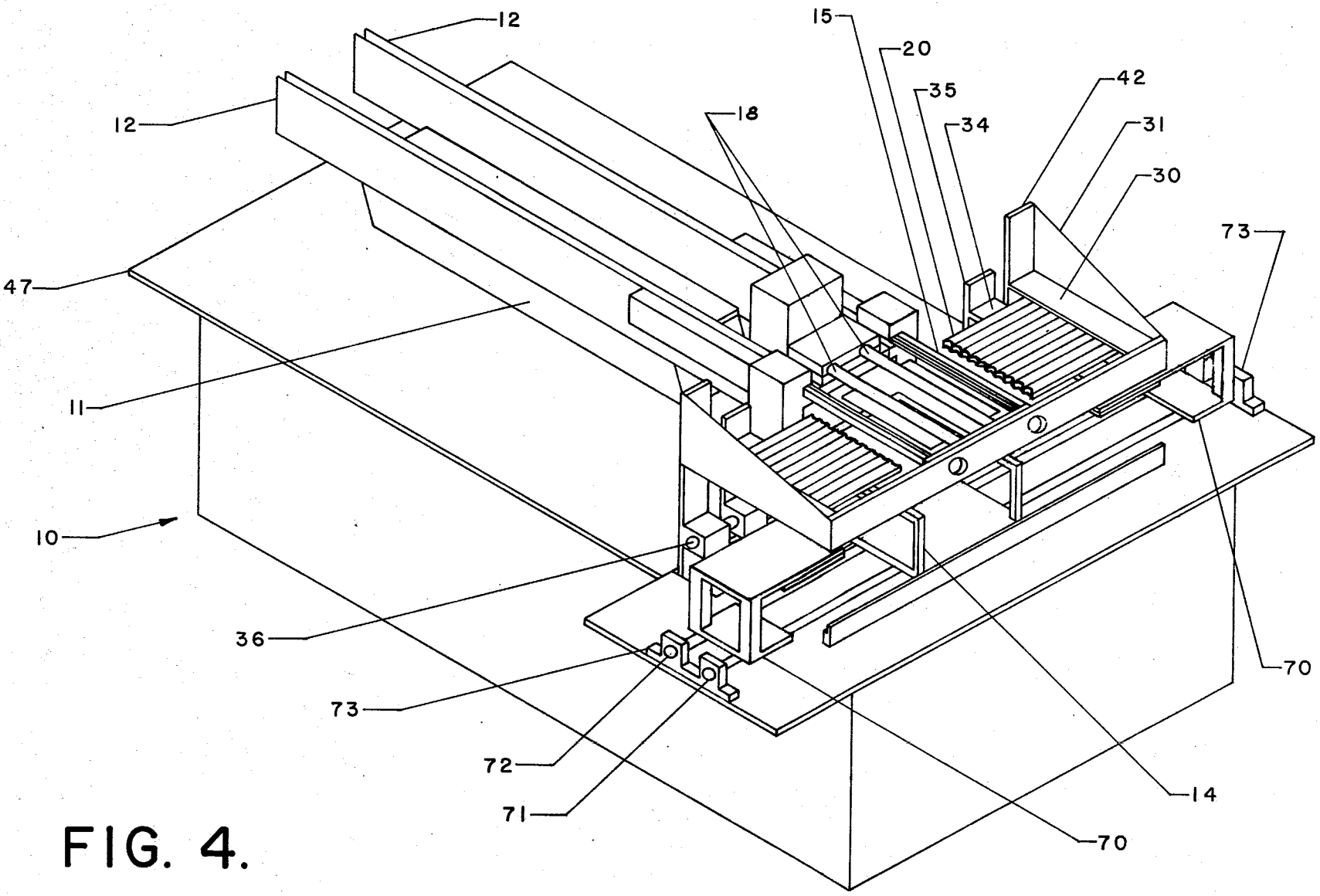
FIG. 4 is an isometric view (with some detail omitted for simplicity of illustration) of the apparatus which performs the steps of FIGS. 1–3.
Figure 5:
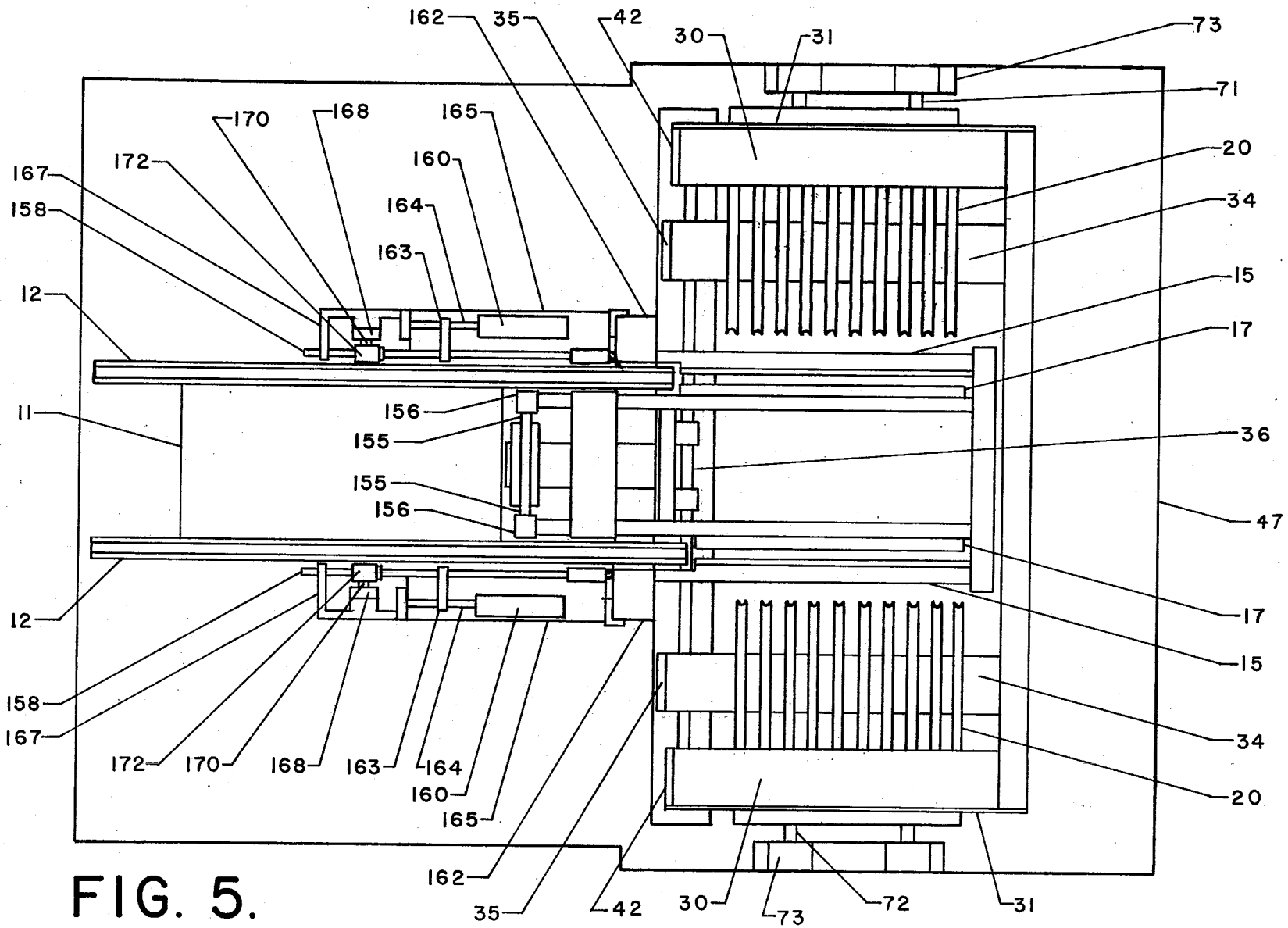
FIG. 5 is a plan view of the apparatus of FIG. 4.

FIGS. 1–3 clearly illustrate how the tray loader 10 of the invention delivers a row of syringe sub-assemblies into a row of openings in a tray. Only a single syringe sub-assembly is visible in each step in FIGS. 1–3 because a row of ten syringe sub-assemblies is therein viewed endwise. How a group of ten syringe sub-assemblies have been segregated from the continuous feed of syringe sub-assemblies will be the subject of a later stage of this description.

Figure 21:
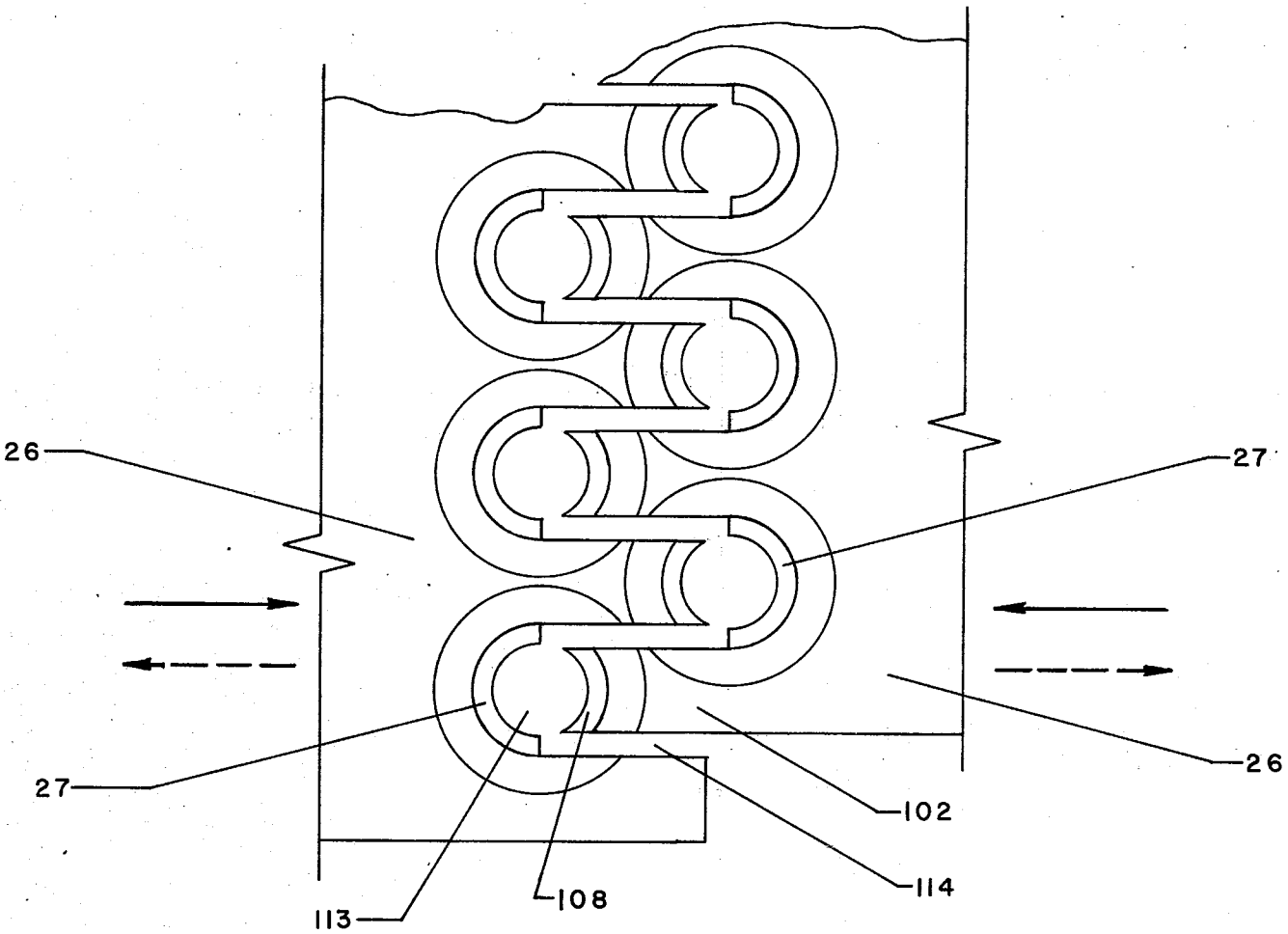
FIG. 21 is a plan view of a pair of the upper guides of FIGS. 19 and 20 in closed condition.
Figure 22:
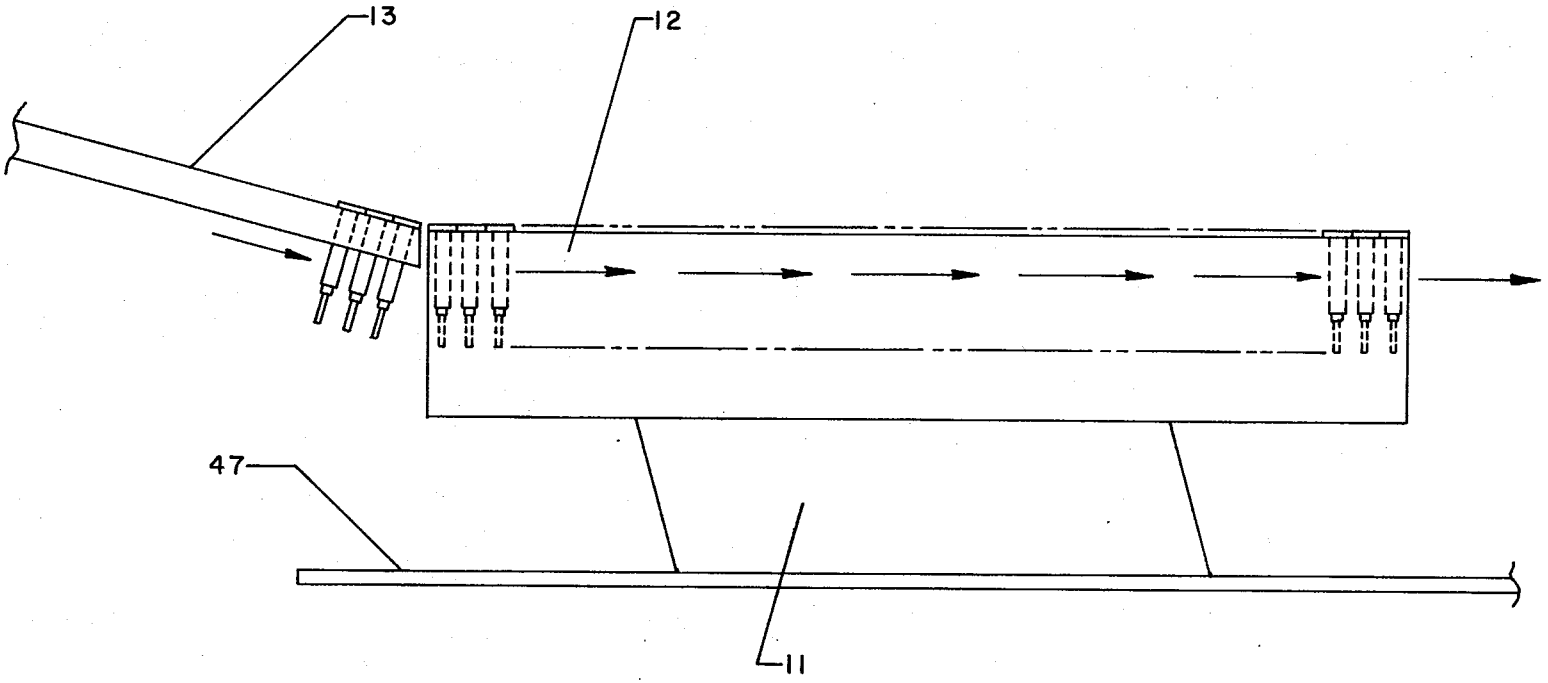
FIG. 22 is a side elevation of the straight line vibratory feeder for the apparatus of the foregoing figures for feeding the syringe sub-assemblies to the tray loading mechanism of the apparatus.

With reference to FIG. 1, it is seen that at the starting position, each syringe sub-assembly of the row is supported in a vertical orientation by engagement of the lip 15*a* of a stationary rail 15 with the underside of the vial flange *f* at one side of the syringe sub-assembly and engagement of an edge portion of a plate or "disappearing guide" 17 with the underside of the vial flange f at the opposite side of the syringe subassembly. The plate 17 and a similar but wider plate or "disappearing guide" 19 are both rigidly mounted on a rotatable shaft 18. At the starting position and in step 1, in which the shaft 18 has not yet been rotated, an edge of the plate 19 abuts against the side wall of each of the vials *v*. The movement from the starting position to step 1 comprises motion of a set of fingers 20, one for each of the syringe sub-assemblies, toward the respective vials *v*. The working end of each of the fingers 20 is provided with a pair of resilient clips 21, which may be referred to as a "fork. In step 1 the pair of clips 21 is being urged onto the vial v by the left-to-right movement of the finger 20. At this step, the plates 17 and 19 brace the vials *v* against the thrust of the fingers 20. When the vials *v* have been completely engaged in the clips 21 so as to be retained thereby, the shaft 18 is rotated more than 90° to disengage the plates 17 and 19 from the vials *v* and then to move the plates 17 and 19 out of the path of the vials *v* as the fingers 20 continue moving from left to right, carrying the syringe subassemblies retained thereby (steps 2 and 3). The clips 21 partly surround the vials *v*, forming an effective internal diameter slightly greater than the diameter of the main body of the vial *v* but less than the minimum diameter of the flange *f* so that the vial *v* slides downwardly slightly in the clips 21 to rest on top of the clips 21 when the support of the plates 17 and 19 and rail lip 15*a* are no longer provided (step 3). A tray 22, to be loaded with syringe sub-assemblies, is supported below the suspended syringe sub-assemblies with the openings of a row of openings in the tray 22 in rough alignment with the suspended syringe sub-assemblies (step 4). It is seen that each opening in the tray 22 is actually in the form of a pair of vertically aligned openings, the upper one 23*a* being in an upper horizontal support sheet 23 of the tray 22 and the lower one 24*a* being in a lower horizontal support sheet 24 of the tray 22. In the transition from step 4 to step 5, the upper and lower guides 26 and 27 arranged with openings therein 26*a* and 27*a* aligned with the openings in the tray 22, are lowered so that the lower portion of each syringe subassembly is received in a respective pair of the openings 26*a* and 27*a*, with the widest top portion of the sheath *s* abutting against the inclined wall 27*b* formed in the opening 27*a*. In actual practice, in steps 4 and 5, as well as subsequent step 6, each of guides 26 and 27 is mated with a like guide to form closed passages at 26*a* and 27*a*, as shown in FIG. 21, but this is omitted from FIGS. 2 and 3 for the sake of simplicity of illustration. It is seen that in step 5, the sheathed needle of the syringe subassembly has passed into the openings 23*a* and 24*a* in the tray 22. In step 6, the fingers 20 have been retracted sufficiently to disengage the clips 21 from the vials *v*. In step 7, the lower guide 27 has been retracted, whereby the upper portion of the sheath s is no longer supported and the syringe sub-assembly has slid vertically down until the flange *f* has been engaged by the periphery of the opening 26*a* in the upper guide. At this point, a substantial portion of each of the vials *v* has been inserted through the openings 23*a* and 24*a* in the tray 22 so that there is no risk of the syringe subassemblies toppling in the next step (step 8) in which the upper guide 26 is retracted thereby to effect complete release of the syringe sub-assemblies so that they descend fully into the tray 22 with the flanges *f* thereof resting on annular portions of the sheet 23 surrounding the openings 23*a*.

Figure 6:
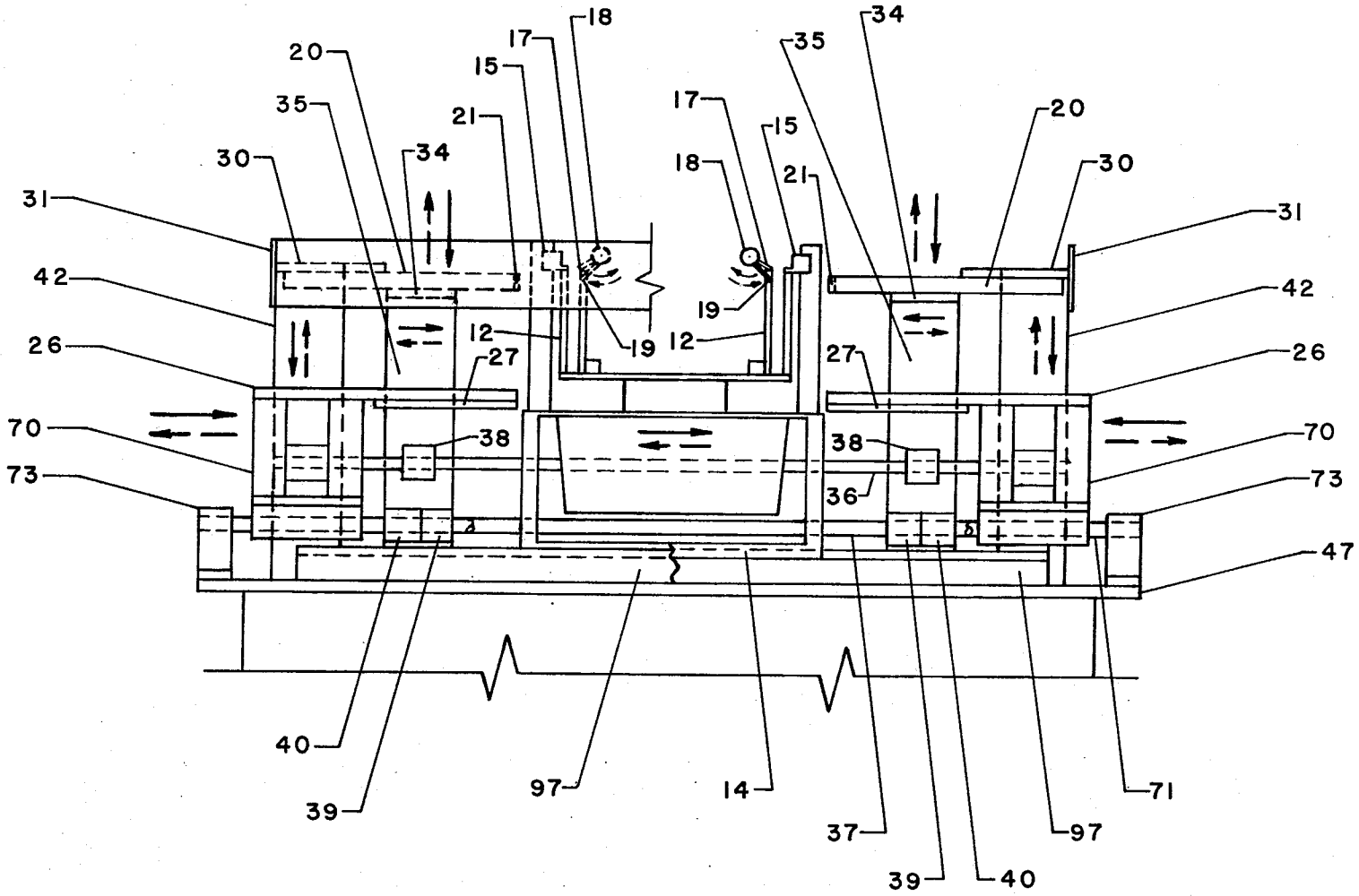
FIG. 6 is a front elevation of the apparatus of FIGS. 4 and 5.
Figure 8:
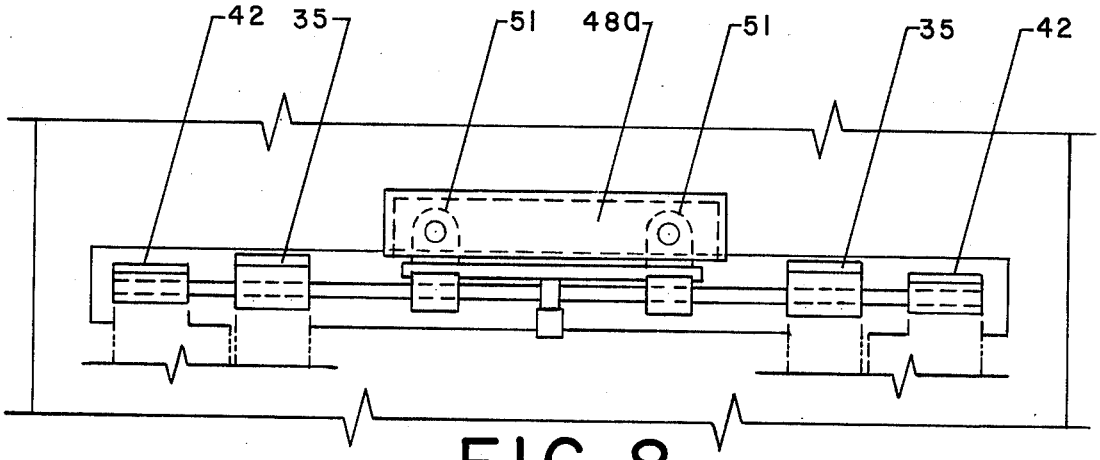
FIG. 8 is a plan view corresponding to FIG. 7.
Figure 7:
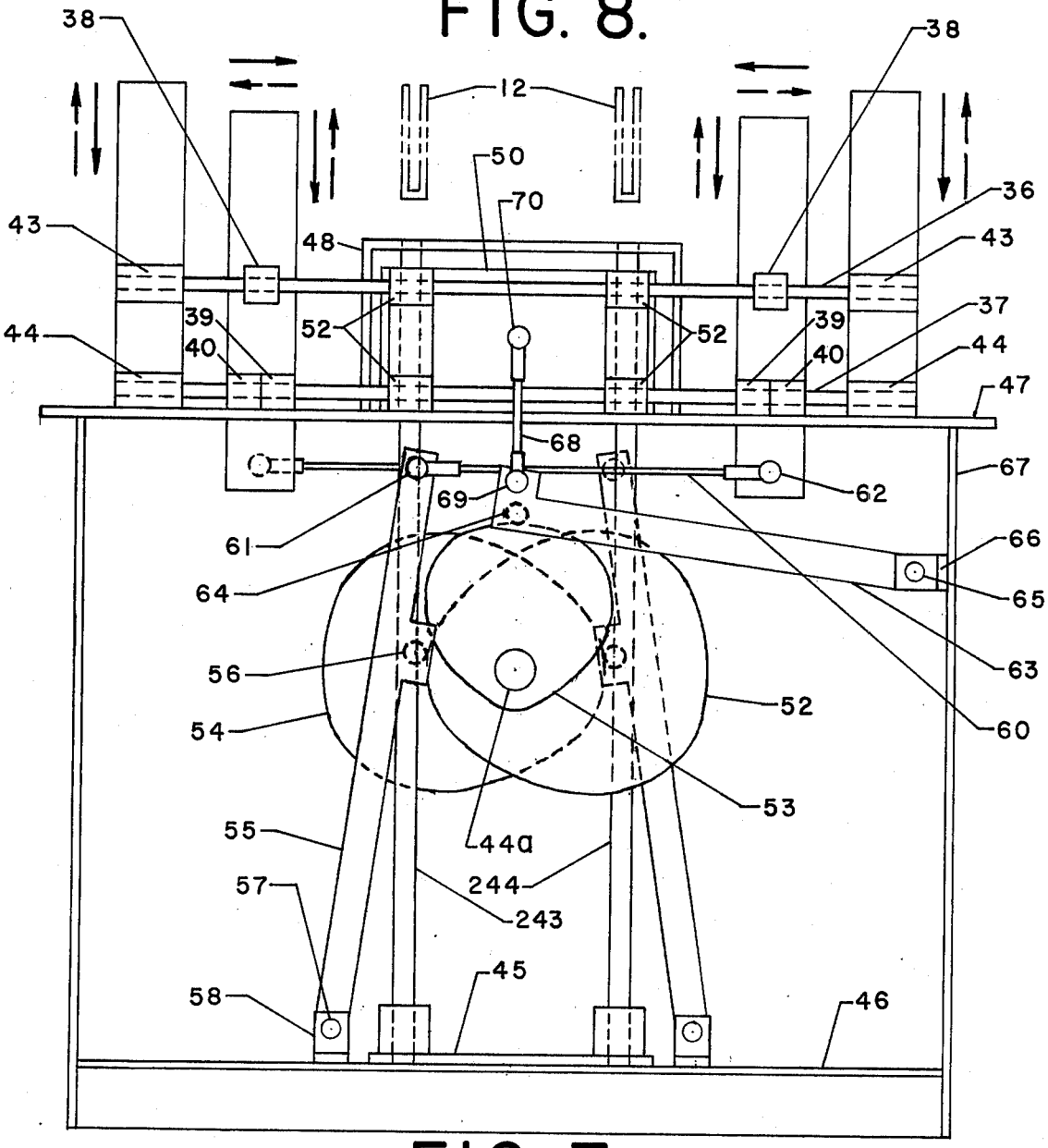
FIG. 7 is a front elevation of the apparatus of the foregoing figures showing part of the drive mechanism.
Figure 17:
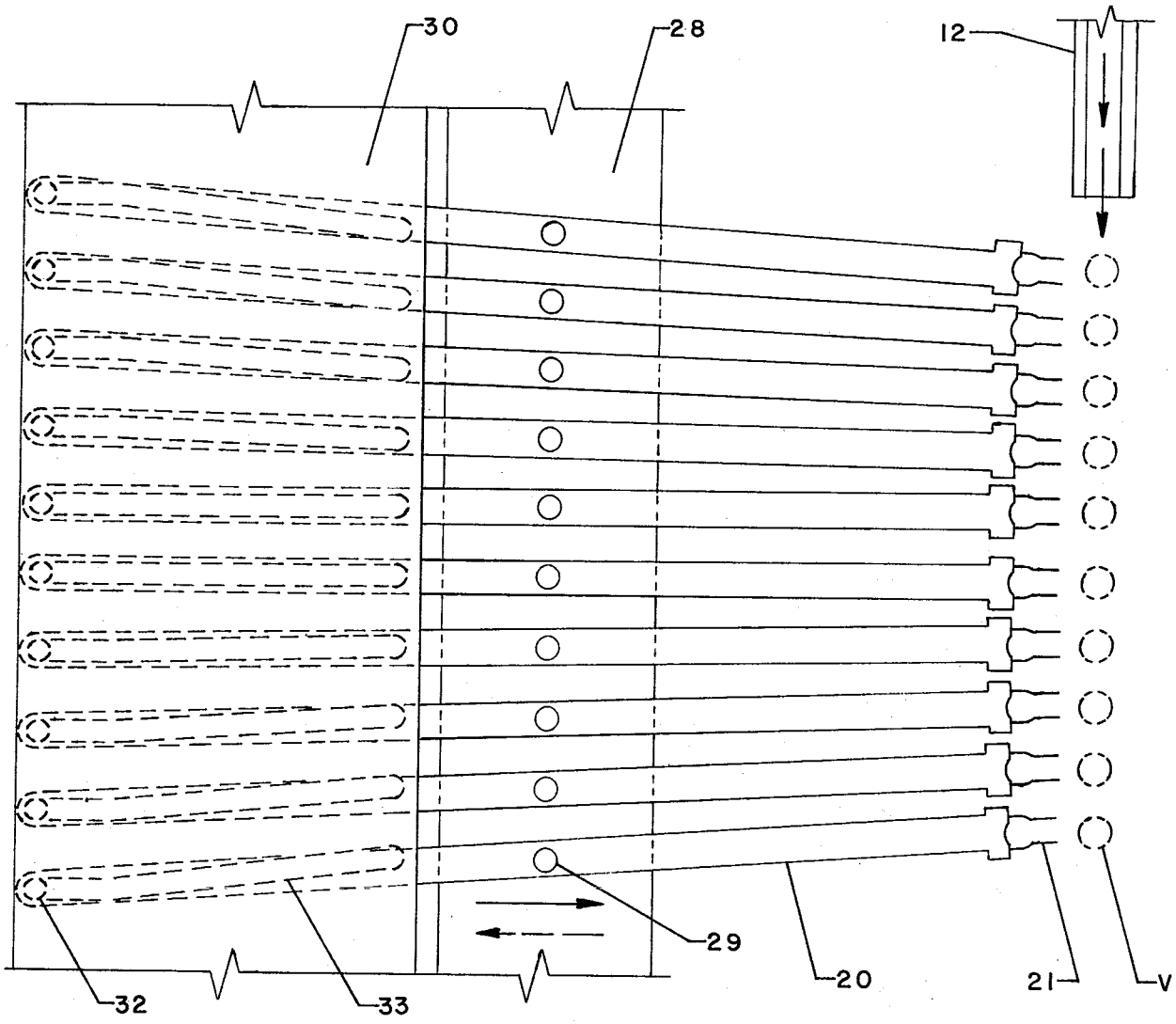
FIG. 17 is a plan view of the portion of the apparatus of the foregoing figures including the aforementioned forks and means for pivoting the forks.

The fingers 20 having resilient clips 21 fastened thereto are pivotally mounted on a stand 28 by means of vertical pivot pins 29 (FIG. 17). A cam track member 30 is supported above the rearward portion of the fingers 20 by means of a holder 31 (FIGS. 6 and 17). Near the end of each finger opposite the end to which the clips 21 are fastened is mounted a vertical pin 32 to serve as a cam track follower. Each pin 32 is received in a track 33 formed in the underside of the cam track member 30 (FIG. 17). A holder 34 for the finger stand 28 is fastened to an arm 35 for moving the finger stand 28 and therewith the fingers 20. The arm 35 is vertically mounted for horizontal sliding on upper and lower horizontal slide rods 36 and 37 by means of slide bearings 38, 39 and 40 (FIGS. 6–8). The cam track holder 31 is fastened to an arm 42 which is non-slidingly vertically mounted on the rods 36 and 37 by means of bearings 43 and 44 (FIGS. 6–8). A pair of vertical slide rods 243 and 244 are supported at their lower ends by a pedestal 45 on the bottom plate 46 of the frame of the machine, pass through openings in the top plate 47 of the frame of the machine and are supported at their upper ends by openings in the horizontal upper member 48*a* of a support frame 48 mounted on the top plate 47. A vertical plate 50 is slidably mounted on the vertical slide rods 43 and 44 by means of four slide bearings 51 fastened to the rear of the plate 50 near the corners thereof, two of which bearings are visible in FIG. 8. The plate 50 is connected to the horizontal rods 36 and 37 by means of four bearings 52 fastened to the front of the plate 50 near the corners thereof.

Figure 18:
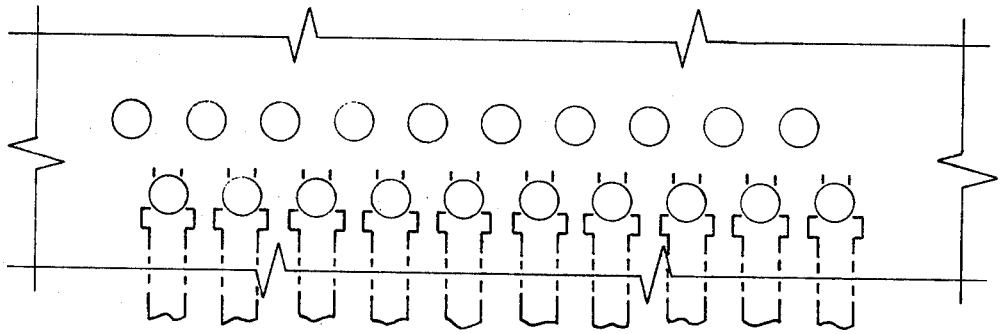
FIG. 18 is a plan view of the forks in engagement with syringe sub-assemblies and holding the sub-assemblies over and in alignment with a row of openings in a tray into which the sub-assemblies are to be loaded.

In order that the fingers 20 perform the movements described in connection with steps 1–6 (FIGS. 1–3), it is necessary that the arms 42 slide horizontally on the rods 36 and 37 and the arms 35 and 42 move together upwards and downwards vertically by a vertical sliding of the plate 50 relative to the rods 43 and 44. This is accomplished by cam actuation. To this end, mounted on a driven cam shaft 44*a* are three cms 52, 53 and 54 (FIg. 7). Cams 52 and 54 are identical and are mounted in mirror image orientations relative to each other since they perform the same function on opposite sides of the machine. The functioning of cam 52 will be described, it being understood that cam 54 functions in just the same way. A lever 55 carrying a cam follower 56 is connected at its lower end by means of a pivotal connection 57 to an ear 58 mounted on the plate 46, the cam follower 56 engaging the edge of the cam 52 and being biased against the edge of the cam 52 in conventional manner by means of a spring (not illustrated). A tie rod 60 is connected to the upper end of the lever 55 by means of a pivotal connection 61 and to the lower end of the arm 35 by means of a pivotal connection 62. As the cam shaft 44*a* is rotated, the lever 55 first pulls the right hand arm 35 to the left and then returns that arm 35 to the right. The arm 35 moves the finger stand 28 which is rigidly connected to the arm 35 by means of the cam stand holder 34. As the stand 28 moves from left to right, the cam tracks 33 first permit the fingers 20 to advance substantially straight forward until the clips 21 engage the syringe vials v (FIG. 17) and then the paths of the pins 32 in the tracks 33 cause the fingers 20 to pivot about the pins 29 to bring the clips 21 carrying the vials *v* to a wider spacing corresponding to the spacing of a row of openings in the tray 22 (FIG. 18). The exact reverse motion of the fingers 20 occurs, of course, during the return leftward movement of the arm 35. In connection with FIG. 18, it is incidentally noted that the openings of consecutive rows of openings in the tray 22 are staggered and that this is accounted for in the construction of the machine by an appropriate offset between the elements of the right hand station and elements of the left hand station which bring the syringe sub-assemblies into alignment with and insert the sub-assemblies in the openings in the tray. The simultaneous vertical movement of the arms 35 and 42 is effected by the cam 53 for both sides of the machine in order to lower the fingers 20 while in their most extended position and the clips 21 thereof are carrying the syringe subassemblies (steps 4 and 5, FIG. 2), whereafter the fingers 20 are retracted (step 6, FIG. 3). To this end, a cam lever 63, mounting a cam follower 64 which engages the edge of the cam 53, is connected at one end by a pivotal connection 65 to an ear 66 secured to a side wall 67 of the frame of the machine. A tie rod 68 is connected to the other end of the lever 63 by a pivotal connection 69 and to the center of the plate 50 by a pivotal connection 70. As the cam 44*a* is rotated, the lever 63 first pulls the plate 50 down and then returns the plate 50 back up. This effects simultaneous down and up movement of the arms 35 and 42 since these are connected to the plate 50 through the rods 36 and 37. Of course, simultaneous vertical movement of the arms 35 and 42 results in vertical movement of the fingers 20.

Figure 10:
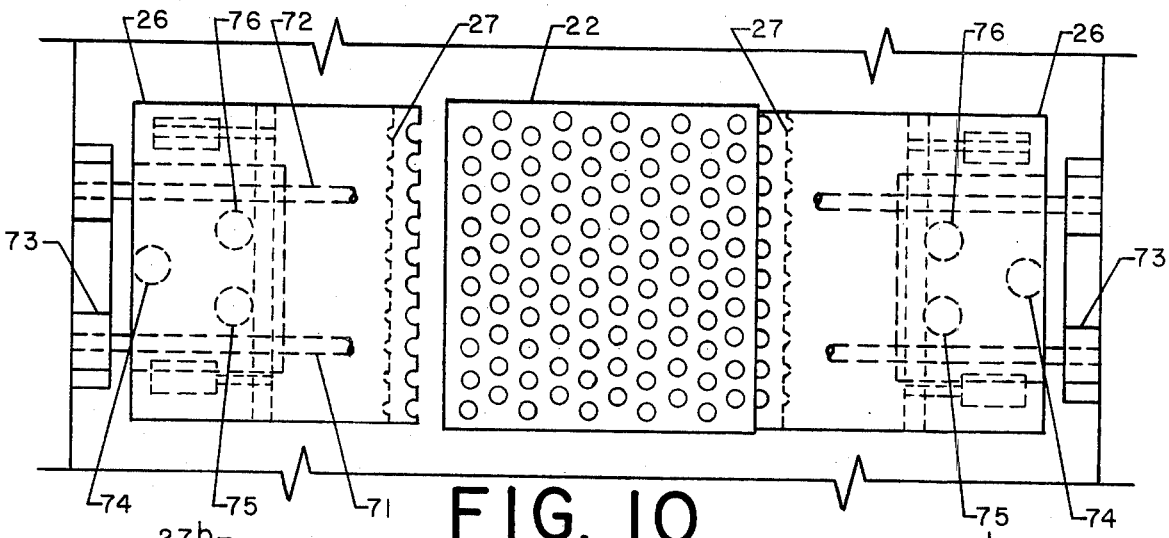
FIG. 10 is a plan view corresponding to FIG. 9.
Figure 9:
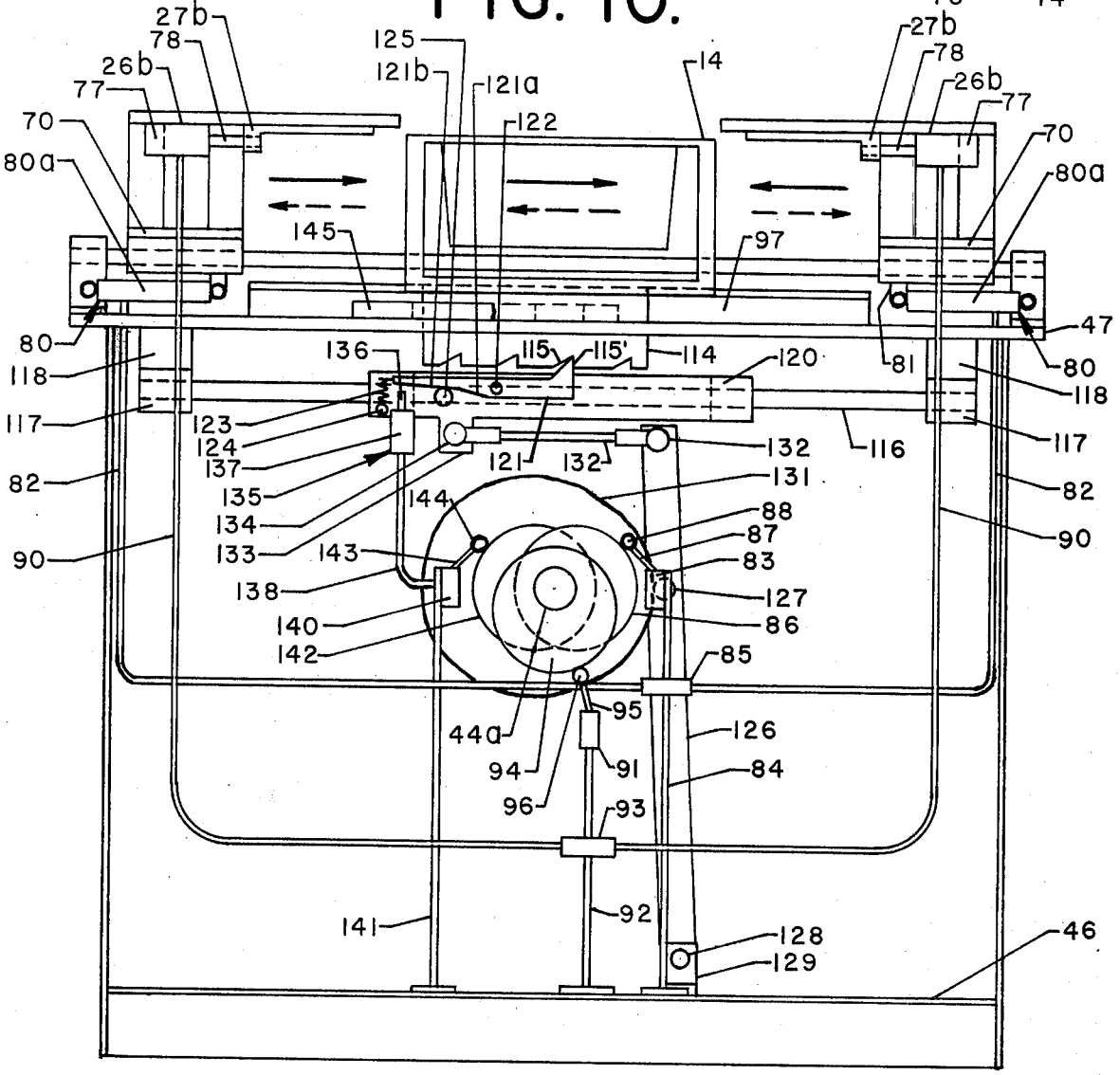
FIG. 9 is a front elevation of the apparatus of the foregoing figures showing an additional portion of the drive mechanism.

The mechanisms for moving the upper and lower guides 26 and 27 between the position of steps 4–6 (FIGS. 2 and 3) and the positions of steps 7 and 8 (FIG. 3) and for indexing the tray carriage 14 from left to right and then returning it from right to left for the beginning of a new cycle can readily be understood by considering FIGS. 9 and 10.

The upper guide 26 and lower guide 27 at each side of the machine are mounted on a respective carriage 70 (FIG. 9). The carriages 70 are slidably mounted on horizontal guide rods 71 and 72 which are slidably received through bores in the carriages 70 (FIGS. 9 and 10). The ends of the rods 71 and 72 are supported in housings 73 fastened to the top plate 47 of the frame of the machine. The mounting plate 26*b* for the upper guide 26 is connected to the carriage 70 by means of vertical posts 74, 75 and 76. An air cylinder 77 is connected to the underside of the mounting plate 26*b*, and the piston 78 of the air cylinder 77 is connected to a member 27*b* to which the lower guide 27 is connected. The carriage 70 is connected to the housing 73 by means of an air cylinder-piston assembly 80 the cylinder 80*a* of which is connected to the housing 73 and the piston of which is connected to an ear 81 on the carriage 70. An air line 82 feeds the cylinder of each of the air cylinder-piston assemblies 80. A valve 83 for controlling the supply of air to the lines 82 and, hence, to the cylinders 80*a* is mounted on a pedestal 84 which is connected to the bottom plate 46 of the machine frame. A line (not illustrated) from a source of compressed air (not illustrated) is connected to the inlet of the valve 83, and a line runs along the upper portion of the pedestal 84 (and, hence, is not visible in FIG. 9) from the outlet of the valve 83 to a union 85 which connects that latter line to the lines 82. The valve 83 is controlled by means of a cam 86 mounted on the cam shaft 44*a*. A lever 87, the movement of which effects opening and closing of the valve 83, is pivotally connected at one end to the valve 83 and has a cam follower 88 mounted on the other end thereof. The lever 87 is spring biased by conventional spring means (not illustrated) toward the cam 86. Thus, the cam 86 regulates the supplying of air to the cylinders 80*a* thereby to control the movement of the carriages 70 and, hence, the simultaneous movement of the upper and lower guides 26 and 27. The movement of the carriages 70 toward each other is powered by the compressed air, and the cylinder-piston assemblies 80, of conventional construction, include spring means for effecting the return movement.

Before the upper and lower guides 26 and 27 are retracted together, it is necessary to retract the lower guides 27 a small distance in order to disengage them from the syringe vials *v* (step 7, FIG. 3). To this end, an air line 90 feeds each of the cylinders 77 (FIG. 9). A valve 91 for controlling the supply of air to the lines 90 and, hence, to the cylinders 77 is mounted on a pedestal 92 which is connected to the bottom plate 46 of the machine frame. A line (not illustrated) from a source of compressed air (not illustrated) is connected to the inlet of the valve 91, and a line runs along the upper portion of the pedestal 92 (and, hence, is not visible in FIG. 9) from the outlet of the valve 91 to a union 93 which connects that latter line to the lines 90. The valve 91 is controlled by means of a cam 94 mounted on the cam shaft 44*a*. A lever 95, the movement of which effects opening and closing of the valve 91, is pivotally connected at one end to the valve 91 and has a cam follower 96 mounted on the other end thereof. The lever 95 is spring biased by conventional spring means (not illustrated) toward the cam 94. Thus, the cam 94 regulates the supplying of air to the cylinders 77 thereby to control independent movement of the lower guides 27. The movement of the guides 27 to bring them into alignment with the guides 26 is powered by the compressed air, and the assemblies of cylinders 77 and pistons 78, of conventional construction, include spring means for effecting the return movement, i.e., the retraction of the guides 27 away from the guides 26 (step 7, FIG. 3).

Figure 19:
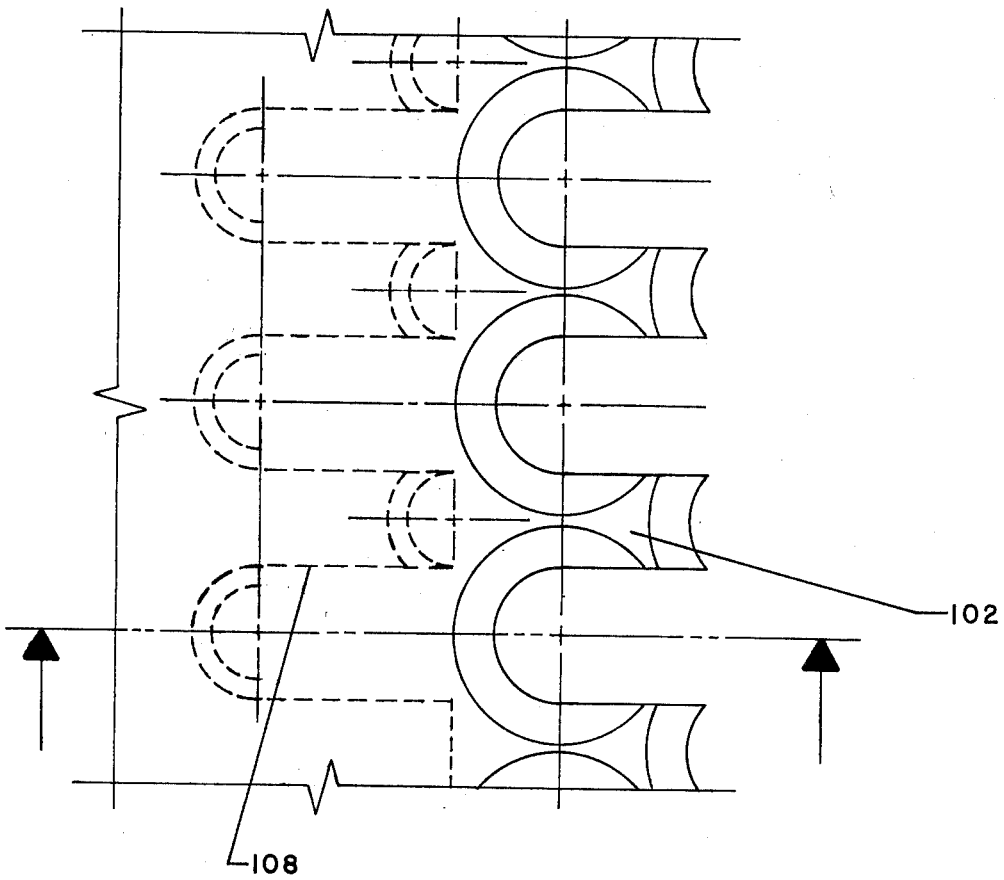
FIG. 19 is a plan view of the upper and lower guides in the apparatus of the foregoing figures for guiding the syringe sub-assemblies into the openings in the tray.
Figure 20:
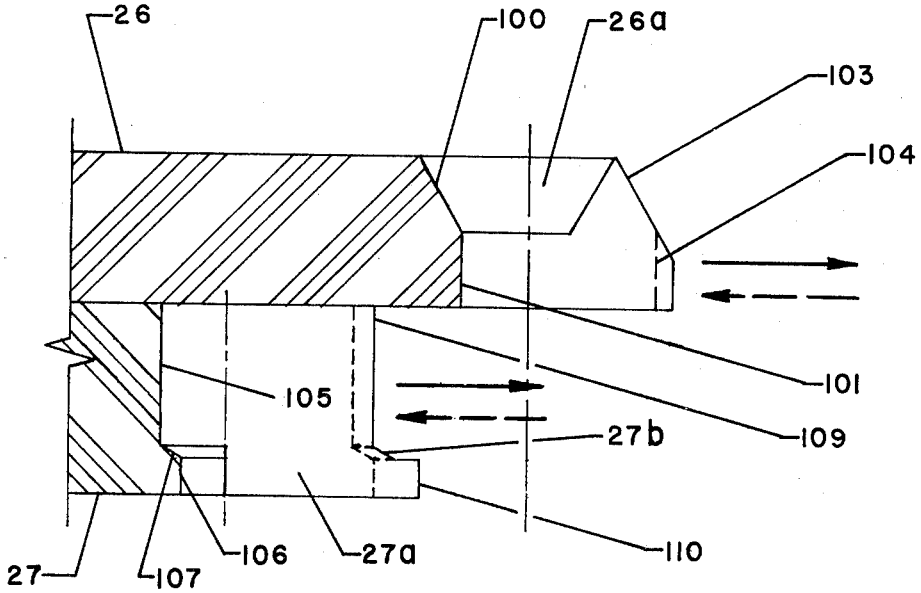
FIG. 20 is a sectional view of the guides of FIG. 19 taken on the section line down in FIG. 19.

As pointed out hereinabove in connection with FIGS. 2 and 3, opposing pairs of upper and lower guides 26 and 27 cooperate, whereas for the sake of simplicity of illustration, in FIGS. 2 and 3 only one half of the pairs is illustrated. The details of the design of the upper and lower guides 26 and 27 and how a pair of such guides cooperate can particularly well be seen in FIGS. 19–21. Each of the openings 26*a* has an inclined wall 100 at its upper portion and a vertical wall 101 at its lower portion (FIGS. 19 and 20). On both sides of the openings 26*a* are fingers 102 likewise having inclined walls 103 and vertical walls 104. Each of the openings 27*a* has a vertical wall 105 at its upper portion, a vertical wall 106 at its lower portion and an inclined wall 107 connecting the vertical walls 105 and 106. On both sides of the openings 27*a* are fingers 108 likewise having vertical walls 109 and 110 and an inclined wall 27*b* connecting the vertical walls 109 and 110. When the opposed upper guides 26 and the opposed lower guides 27 are both brought together for engagement with the syringe vials, the fingers 102 of the upper guides 26 interleaf and the fingers 108 of the lower guides 27 interleaf (FIG. 21) so as to form circular openings having small vertical openings 113 in the essentially cylindrical and frustoconical walls thereof, the openings 113 resulting from the clearances 114 provided between the opposed fingers to assure that they interleaf without colliding.

Regarding the indexing of the carriage 14 carrying the tray 22 horizontally across the machine perpendicular to the rows of openings in the tray 22 for receiving the syringe subassemblies, reference is made to FIG. 9. The carriage 14 rests on a pair of horizontal rails 97 (only one of which is visible in FIG. 9) which extend perpendicularly across the machine and the front one of which (FIG. 9) engages the front edge of the carriage 14 while the rear one engages the rear edge of the carriage 14. The rails 97 are fastened to the top plate 47 of the machine frame. Fastened to the bottom of the carriage 14 is a ratchet bar 114 having notches 115. A horizontal rod 116 of square cross-section extending perpendicularly across the machine below the ratchet bar 114 is supported at its ends in blocks 117 connected to housings 118 suspended from the top plate 47 of the machine frame. A tray indexer bar 120 is slidably mounted on the rod 116 by means of a square passage through the length of the bar 120 and through which the rod 116 is slidably received. A ratchet pawl 121 is pivotally mounted on the bar 120 by means of a pivot pin 122. The pawl 121 is rotationally biased counterclockwise by means of a spring 123 one end of which is connected to the end of the pawl 121 opposite the end which engages the ratchet bar 114 and the other end of which is fastened to the bar 120 by means of a pin 124. A cam follower 125 is suspended from the underside of the top plate of the machine frame 125 by ordinary bracket or housing means which have not been illustrated for the sake of maintaining the clarity of FIG. 9. The cam follower 125 engages a lower edge portion 121*a* of the pawl 121 which edge portion functions, as will hereinafter be explained, as a cam. A lever 126 carrying a cam follower 127 is connected at its lower end by means of a pivotal connection 128 to an ear 129 mounted on the plate 46. The cam follower 127 engages the edge of a cam 131 mounted on the cam shaft 44*a*, the lever 126 being biased toward the cam 121 by spring means (not illustrated). A tie rod 132 is connected to the upper end of the lever 126 by means of a pivotal connection 132 and to an ear 133 on the bar 120 by means of a pivotal connection 134. An air cylinder-piston assembly 135 is mounted vertically on the bar 120 with the piston 136 thereof, when retracted, immediately below the bottom edge of the end of the pawl 121 to which the spring 123 is connected. An air line 138 is connected to the outlet of a valve 140 and feeds the cylinder 137. The valve 140, which controls the supply of air to the line 138 and, hence, to the cylinder 137, is mounted on a pedestal 141 which is connected to the bottom plate 46 of the machine frame. A line (not illustrated) from a source of compressed air (not illustrated) is connected to the inlet of the valve 140. The valve 140 is controlled by means of a cam 142 mounted on the cam shaft 44*a*. A lever 143, the movement of which effects opening and closing of the valve 140, is pivotally connected at one end to the valve 140 and has a cam follower 144 mounted on the other end thereof. The lever 143 is spring biased by conventional spring means toward the cam 142.

Indexing of the carriage 14 by each single notch of the ratchet bar 114 proceeds as follows. As the cam shaft 44*a* rotates, engagement of the cam 131 with the cam follower 127 causes the lever 126 to pull the bar 120 to the right. Consequently, the pawl 121, which is engaged in a notch 115 of the ratchet bar 114, carries the ratchet bar 114 and, therewith, the carriage 14 to the right. Then, the continued rotation of the cam shaft 44*a* causes the lever 126 to pull the bar 120 to the left back to its start position. First, however, the pawl 121 must be disengaged from the notch 115. To this end, the piston 136, which is spring biased downwards, is actuated upwards due to the reaching of the cam 142 of the rotational orientation to effect a movement of the lever 143 which opens the valve 140. Accordingly, the piston 136 engages the bottom edge of the end of the pawl 121 adjacent the spring 123 and imparts sufficient clockwise displacement to the pawl 121 to disengage the pawl 121 from the notch 115. The cam follower 125 engages the inclined cam-like edge 121*a* of the pawl 121 and the piston 136 retracts as the bar 120 continues its leftward movement toward its start position, the engagement of the cam follower 125 with the cam-like edge 121*a* imparting a clockwise moment to the pawl 121 and thereby holding the pawl 121 out of engagement with the ratchet bar 114. Then, the pawl 121 reaches a position at which the apex of the tooth-shaped portion thereof is slightly to the left of the apex of the notch 115' and the cam 131 causes the lever 126 to pull the bar 120 to the right. When the tooth-shaped portion of the pawl 121 is aligned with the notch 115' ("start position"), the pawl 121 has moved sufficiently to the right relative to the cam follower 125 that the cam follower 125 now is in engagement with the relatively horizontal lower edge portion 121*b* of the pawl 121, the transition from engagement with the edge portion 121*a* to engagement with the edge portion 121*b* permitting the spring 123 to rotate the pawl 121 clockwise sufficiently to engage the tooth-shaped portion thereof in the notch 115'. The carriage 14 is kept from moving beyond each position to which it is indexed by the pawl 121 by a simple friction brake assembly 145 in the form of a spring holder member mounted on the top of the plate 47 on each side of the ratchet bar 114 and brake shoes engaging each side of the bar 114, the brake shoes being biased against the bar 114 by means of compression springs connecting the brake shoes to the spring holder members. The force imparted by the indexing action is sufficient to overcome the brake resistance.

When a loading cycle has been completed and the carriage 14 is to be returned for the loading of another tray (or the loading of the remaining unloaded alternate rows of the tray in the event only one of the left or right hand sides of the machine is loading the trays), the piston 136 is actuated to disengage the pawl 121 from the ratchet bar 114 and the operator manually returns the carriage 14 to its start position. More particularly, after the final indexing and loading of the last row of the tray 22, the cam shaft 44*a* continues to rotate sufficiently for the cam 142 again to reach a rotational orientation to effect a movement of the lever 143 which opens the valve 140. Accordingly, the piston 136 disengages the pawl 121 from the ratchet bar 114. Then, the cam follower 125 holds the pawl 121 out of engagement with the ratchet bar 114. A microswitch is actuated to cut off the power to the motor driving the cam shaft 44*a* and the operator manually returns the carriage to its start position with the apex of the retracted tooth-like end of the pawl 121 somewhat to the left of the apex of the leftmost notch of the ratchet bar 114. When the power is switched on to start a new loading cycle, the re-started rotation of the cam shaft 44*a* causes the cam 131 to push the lever 126 and, therewith, the bar 120 to the right and the ratcheting action proceeds in the manner hereinabove described.

The mechanism for oscillating the shaft 18 to which the plates 17 and 19 are affixed is shown in detail in FIGS. 13–16. A rod 146 is reciprocated by engagement of a cam 147 mounted on the cam shaft 44*a* with a cam follower 148 mounted on a lever 149 to an ear 149*a* of which the rod 146 is connected by means of a pivotal connection 150, one end of the lever 149 being pivotally connected to a fixed member 151 of the machine frame by means of a pivotal connection 152 and the other end of the lever 149 being connected to the bottom plate 46 of the frame of the machine by means of a spring 153 which biases the cam follower 148 against the cam 147. A guide 154 mounted on the top plate 46 restrains the to-and-fro movement of the rod 146 to a vertical path. A rack 155 is vertically mounted on the rod 146 and engages a spur gear 156 mounted on the end of the shaft 18, thus translating the reciprocation of the rod 146 into oscillation of the shaft 18.

Figure 11:
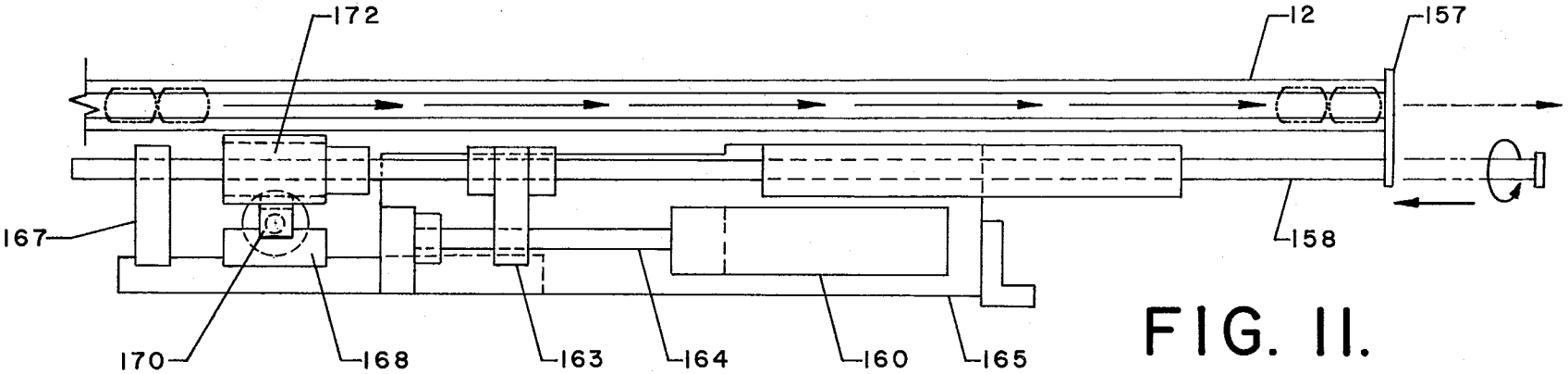
FIG. 11 is a plan view of the portion of the apparatus of the foregoing figures for alternately holding back the feed of syringe sub-assemblies when enough have been fed for a cycle of the tray loader and then permitting feeding for the next cycle.
Figure 12:
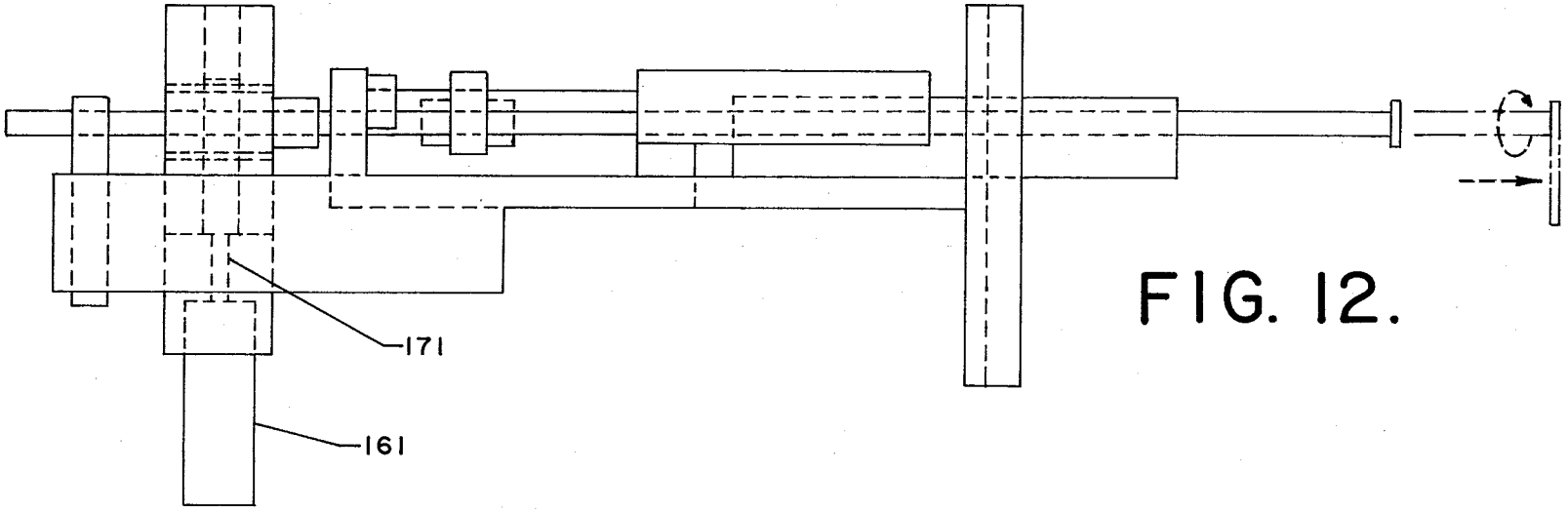
FIG. 12 is a front elevation corresponding to FIG. 11.
Figure 14:
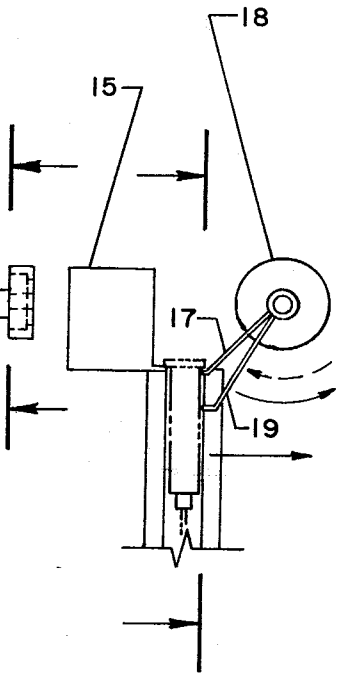
FIG. 14 is a front elevation corresponding to FIG. 13.
Figure 13:
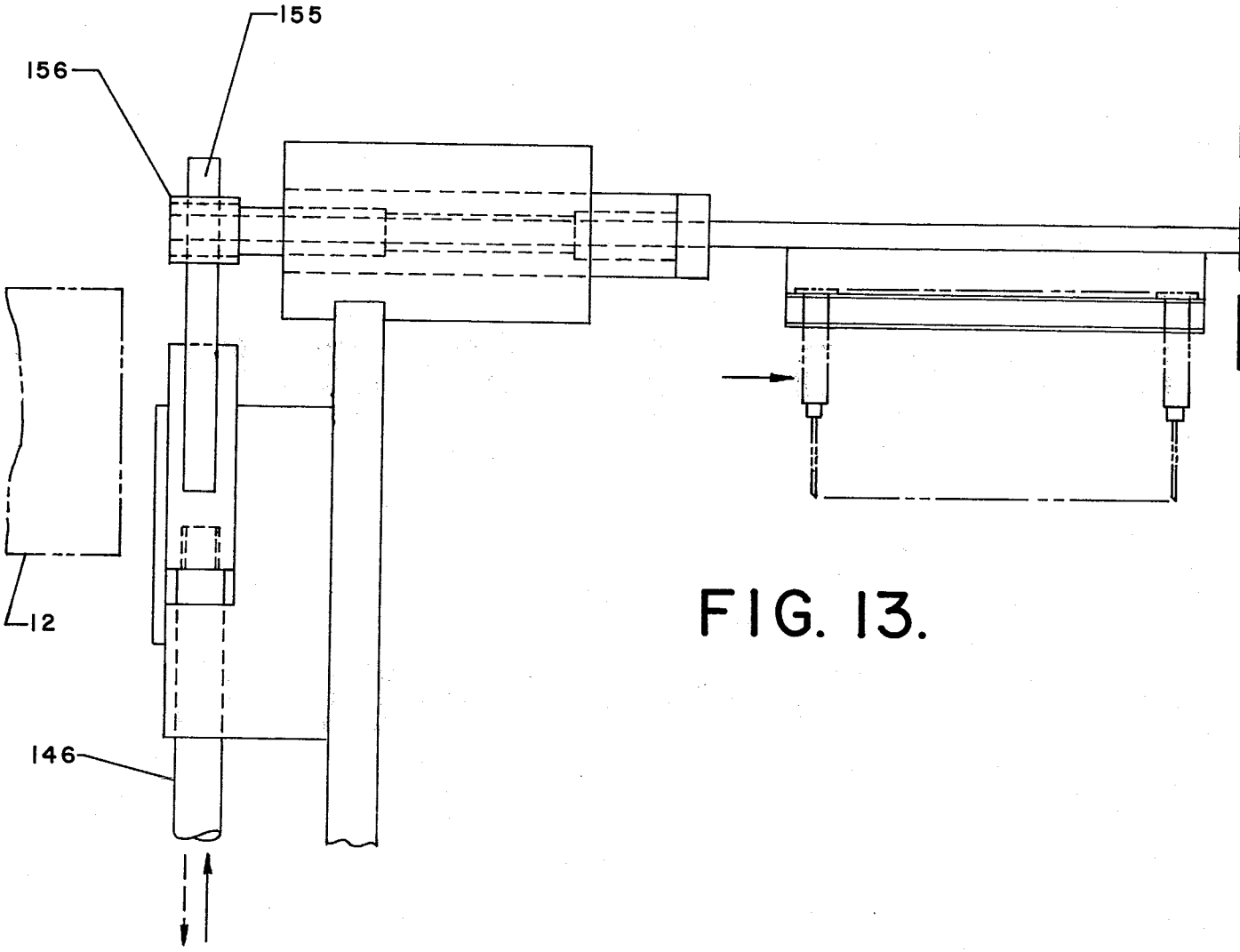
FIG. 13 is a side elevation of the portion of the apparatus of the foregoing figures for supporting a row of syringe sub-assemblies before the sub-assemblies are engaged by forks for alignment with a corresponding row of openings in the tray.
Figure 15:
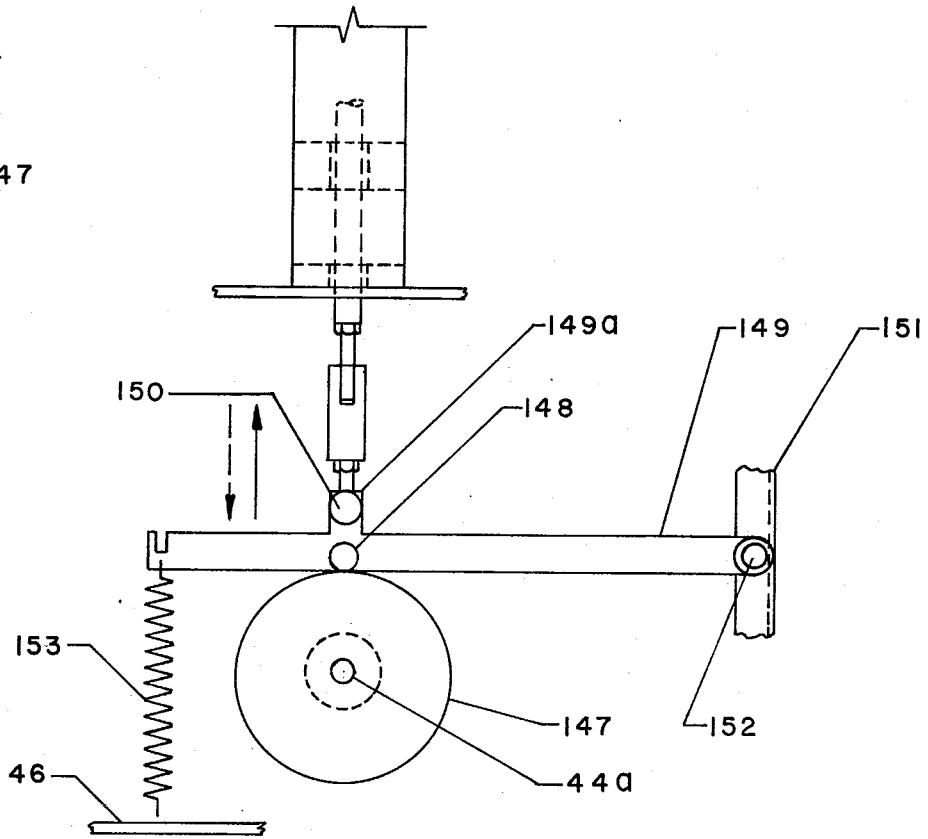
FIG. 15 is a front elevation of the cam mechanism for actuating the apparatus of FIGS. 13 and 14.
Figure 16:
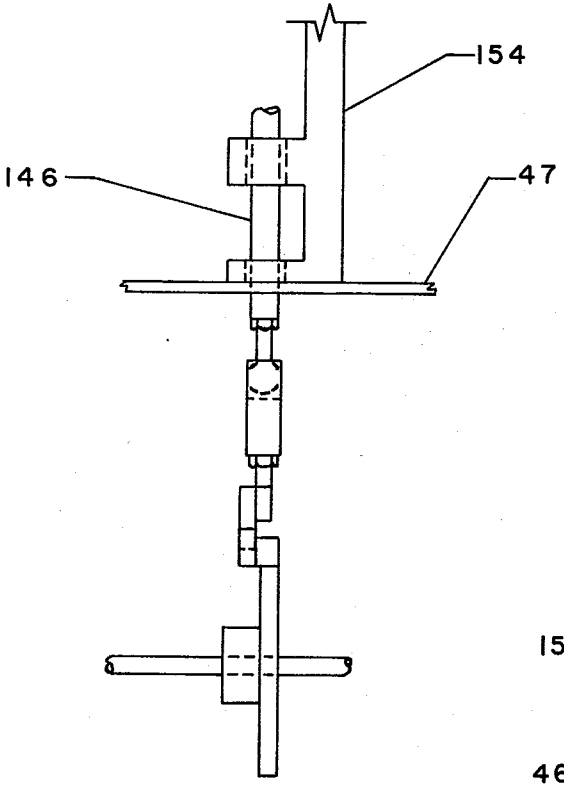
FIG. 16 is a side elevation corresponding to FIG. 15.

Since the operation of the tray loader of the invention is cyclical, it is necessary to regulate the feeding of syringe sub-assemblies thereinto in a cyclical manner. To this end, there is provided the apparatus illustrated in FIGS. 11 and 12. As noted hereinabove, the particular machine illustrated in this application loads rows in the tray 22 taking ten syringe subassemblies per row. The syringe sub-assemblies continuously advance along the tracks 12 of the vibratory feeder 11. From the tracks 12 the syringe sub-assemblies are received with the flanges *f* (the exact shape of which is, incidentally, as shown in FIG. 11, not circular) of the vials *v* supported by the lip 15*a* of the rail 15 and the disappearing guide 17, which abut the downstream end of the tracks 12. The capacity of the tracks formed by the cooperation of the lip 15*a* with the guide 17 is a few more than 10 syringe sub-assemblies. At the beginning of a cycle, the apparatus of FIGS. 11 and 12 is actuated to insert an ear 157 between the vials *v* of the 10th and 11th syringe subassemblies on the lip 15*a* and disappearing guide 17 and to retract the ear counter to the direction in which the syringe subassemblies are being advanced by the feeder 11 to a rest position abutting the downstream end of the track 12 thereby to block the advance of additional syringe sub-assemblies until the next row of the syringe sub-assemblies is to be loaded. The ear 157 is mounted on a shaft 158. The sequence of axial and rotational movements of the shaft 158 is as follows. The shaft 158 is retracted and at an orientation such that the ear 157 is directed vertically downwards. Since the shaft 158 is laterally spaced from the tracks 12 (which, incidentally, have been omitted from FIG. 12 for the sake of simplicity of illustration), the ear 157 in the shaft 158 position just described is alongside the downstream end of the tracks 12, not blocking the tracks 12. At any time after the lip 15*a* and disappearing guide 17 arrangement is loaded to capacity, the shaft 158 is extended and then rotated 90° to bring up the ear 157 between the vials *v* of the 10th and 11th syringe sub-assemblies. Then the shaft 158 is retracted to cause the ear 157 to pull back the excess syringe sub-assemblies onto the tracks 12 and block the advance of syringe sub-assemblies from the tracks 12, as hereinabove described. When the arrangement of the lip 15*a* and disappearing guide 17 is to be fed with syringe sub-assemblies for a new loading cycle, the shaft 158 is rotated 90° in the reverse direction to return to the position described as the starting position of the sequence of axial and rotational movements of the shaft 158.

The axial movement of the shaft 158 is imparted by an air cylinder 160 and the rotational movement of the shaft 158 is imparted by an air cylinder 161 (FIGS. 11 and 12). Each of the air cylinders 160 and 161 is of the type in which retraction of the piston is powered by a spring which is stressed as the compressed air drives the piston forward. The air cylinder 160 is mounted on a bracket 165 secured to a post 162 whereby this apparatus is supported alongside the outer one of the rails 12. A link 163 connects the piston 164 of the cylinder 160 to the shaft 158 so that the shaft 158 moves axially with the piston 164. A block 168 partly into the bottom of which the air cylinder 161 is vertically mounted is connected to the bracket 165. The bracket 165 supports a shaft housing 167 through which the shaft 158 passes. A rack housing 168 is vertically mounted partly into the top of the bracket 165. A gear rack 170 is vertically supported by the housing 168 for vertical reciprocation relative to the housing 168. The rack 170 is connected to the end of the piston 171 of the air cylinder 161. The rack 170 is in engagement with a spur gear 172 mounted on the shaft 158. The rack 170 and gear 172 translate axial movement of the piston 171 into rotational movement of the shaft 158.

While the invention has been particularly described by reference to a specific embodiment thereof, it is to be understood that such description is intended to illustrate rather than limit the invention as defined by the hereto appended claims.

What is claimed is:

1. Apparatus for loading a plurality of articles into a receptacle having parallel rows of openings each of which is adapted to receive a respective one of the articles, comprising a loading station including means for guiding and supporting said articles in a row parallel to and spaced above and laterally of a row of said openings to be filled with the row of articles, said guiding and supporting means including movable guide means for engaging the row of articles laterally, means for moving said movable guide means between a position in which said movable guide means laterally engages the row of articles and a position in which the movable guide means is disengaged from the row of articles, carrying means for the row of articles, means for moving the carrying means into engagement with the articles thereby to provide support for and carry the articles when the movable guide means is disengaged from the articles and for then moving the carrying means with the row of articles carried thereby laterally toward and into vertical alignment with the openings of the row of said openings to be filled with the row of articles, means for increasing the spacing between the carrying means to a spacing corresponding to the spacing between the openings of the row to be filled as the articles are laterally carried by the carrying means into vertical alignment with the openings of the row to be filled and means for moving the carrying means vertically downwardly thereby to lower the articles partly into the openings, said means for moving the carrying means laterally including means for then moving the carrying means laterally in reverse of the former lateral movement thereby to disengage the carrying means from the articles partly received in the openings to permit the articles to descend further into the openings.

2. Apparatus according to claim 1, including means for receiving and guiding the lower portion of each of the articles into each respective opening when the carrying means lower the articles and means for moving said receiving and guiding means laterally from a position laterally spaced from the row of openings being filled to a position in vertical alignment with the openings thereby to perform said receiving and guiding of the lower portion of each of the articles and then, after the carrying means has been disengaged from the articles, laterally back to the original position thereof thereby to disengage the lower portion of each of the articles and permit the articles to descend further into the openings whereby the loading of the row of articles into the row of openings is completed.

3. The combination of loading apparatus according to claim 1 and means for continuously feeding the articles to the means in the loading station for guiding and supporting the articles in a row, the guiding and supporting means being of such length as to have a capacity to receive from the feeding means a row of the articles of greater number than the number of openings in the row of openings in the receptacle for receiving the articles and the loading apparatus including pulling and holding back means for pulling back into the feeding apparatus the excess articles on the guiding and supporting means and holding back the feeding of additional articles from the feeding means into the loading apparatus while the row of articles remaining in the loading apparatus is loaded by the loading apparatus in the row of openings in the receptacle.

4. Apparatus according to claim 1, including a carriage for supporting the receptacle and means for horizontally indexing the carriage perpendicularly to the rows of openings in the receptacle thereby to bring successive rows of empty openings into position for loading with respective rows of articles.

5. Apparatus according to claim 1, including like laterally spaced loading stations on opposite sides of the apparatus.

6. The combination according to claim 3, the loading apparatus including like laterally spaced loading stations on opposite sides of the apparatus and the combination including a second continuous feeding means, each of the feeding means feeding to the guiding and supporting means of a respective one of the loading stations.

7. Apparatus according to claim 4, including like laterally spaced loading stations on opposite sides of the apparatus, the loading stations being arranged so that the indexing of the carriage results in one of the loading stations loading articles in the rows of openings of one lateral half of the receptacle while the other loading station loads articles in the rows of openings of the other lateral half of the receptacle.

8. Apparatus according to claim 2 for loading syringe sub-assemblies into trays in which each of the openings is in the form of vertically spaced upper and lower openings in respective upper and lower vertically spaced horizontal plates of the tray, said syringe sub-assemblies each comprising a cylindrical vial having a flange at one end thereof and a hypodermic needle affixed to the other end thereof and a sheath received over the needle, the sheath being open at the end through which the needle is received and being of greater outside diameter at that end than elsewhere, the sub-assemblies to be loaded with the sheath covered needles thereof pointed vertically downwards, the receiving and guiding means comprising upper and lower receiving and guiding means and the apparatus further comprising means for moving the lower guiding and receiving means laterally away from the sub-assemblies before the upper guiding and receiving means is so moved.

9. Apparatus according to claim 8, in which the lower receiving and guiding means include respective surfaces for supporting each of the sub-assemblies by engaging the periphery of the upper end of the sheath of each thereof and the upper receiving and guiding means include respective surfaces for supporting each of the sub-assemblies by engaging the flange of the vial of each thereof, the receiving and guiding means being vertically spaced above the openings a distance such that when both the upper and lower receiving and guiding means are in engagement with the sub-assemblies, the sub-assemblies are supported by the lower receiving and guiding means with the lowermost extremity of each of the sheaths extending into a respective opening in the lower plate of the tray, and when the lower receiving and guiding means is withdrawn before the upper receiving and guiding means, the sub-assemblies slide down deeper into the tray until the sub-assemblies are supported by the upper receiving and guiding means, whereby the subsequent withdrawing of the upper receiving and guiding means permits the articles to descend further into the openings and completes the loading of the row of articles into the row of openings.

* * * * *